United States Patent [19]

McCormick

[11] 3,945,703

[45] Mar. 23, 1976

[54] SNAP ACTION CONNECTOR

[75] Inventor: Larry L. McCormick, Los Angeles, Calif.

[73] Assignee: G & H Technology, Inc., Santa Monica, Calif.

[22] Filed: Dec. 23, 1974

[21] Appl. No.: 535,291

Related U.S. Application Data

[63] Continuation of Ser. No. 326,460, Jan. 24, 1973, abandoned.

[52] U.S. Cl. ..... 339/89 M

[51] Int. Cl.[2] ..... H01R 13/54

[58] Field of Search ..... 339/34, 42, 45, 46, 63–66, 339/75, 89–92, 143, 176, 177; 285/340, 354, 386; 403/11, 16

[56] References Cited

UNITED STATES PATENTS

| | | | |
|---|---|---|---|
| 3,016,249 | 1/1962 | Contreras et al. | 285/340 |
| 3,212,050 | 10/1965 | Stark | 339/90 C |
| 3,368,182 | 2/1968 | Culver | 339/91 |
| 3,848,950 | 11/1974 | McCormick et al. | 339/90 R |

*Primary Examiner*—Joseph H. McGlynn
*Attorney, Agent, or Firm*—Dan R. Sadler

[57] ABSTRACT

An electrical connector having a breech lock is provided with a snap action or over-center spring such as a Belleville Washer. This is effective to positively bias all of the working parts of the connector into the fully mated or unmated positions. It is also effective to maintain the connector and the electrical contacts therein mated even though it may be subjected to large forces resulting from acceleration, vibration, etc., and to maintain all of the interfaces sealed even though the sealing materials may shrink, etc., from aging, etc.

21 Claims, 5 Drawing Figures

SNAP ACTION CONNECTOR

CROSS-REFERENCE TO RELATED APPLICATIONS

This application is a continuation of co-pending application for U.S. Patent for Ser. No. 326,460 filed Jan. 24, 1973, and now abandoned, for SNAP ACTION CONNECTOR, on behalf of Larry L. McCormick and assigned to G & H Technology, Inc.

BACKGROUND

A large variety of different types of electrical connectors exist for joining the individual wires in a first cable with the individual wires in a second cable. Although many of these connectors are satisfactory for their intended purposes, many have limitations which reduce their usefulness for some purposes. The two sections of the connector have usually been secured together by a threaded nut, etc. This requires a considerable amount of manual manipulation to mate the sections, i.e., screwing the parts together, etc. This can be a time consuming operation. Moreover, if the connector is located in an inaccessible location which is difficult to reach, the mating and threading together of the sections can be very difficult. In those connectors which have a large number of individual electrical contacts which must be forced together during mating, the loads on the individual parts of the sections have been high. As a consequence, some parts of the connector sections such as the locking mechanisms have failed prematurely. In addition, these large forces have made it difficult to fully mate all of the electrical contacts.

More recently it has been proposed to employ an improved connector of the type disclosed and claimed in copending application Ser. No. 287,184 entitled "ELECTRICAL CONNECTOR" filed Oct. 7, 1972 in the names of Larry L. McCormick and Ben L. Selk and assigned of record to G & H Technology Inc. In this improved electrical connector a breech lock is provided for securing the two sections together. This has greatly simplified the use of the connector, particularly the mating and unmating thereof.

SUMMARY

The present invention as disclosed herein, is embodied in an electrical connector having two separate sections which can be readily mated and/or unmated. The connector includes a breech lock for releasably securing the two sections together and an overcenter spring such as a Belleville Washer for biasing the two sections into position. In order to mate the two sections they are first brought together. The breech lock is rotated whereby they are prevented from separating. As the rotation of the breech lock continues, an overcenter spring (i.e., a Belleville Washer) drives all of the electrical contacts together with a "toggle" or snap action. This spring also keeps all of the contacts continually biased together. In order to unmate the two sections, the breech lock is rotated in the opposite direction. The initial part of the rotation moves the spring overcenter whereby the contacts are quickly "snapped" apart. Continued rotation causes the breech lock to release whereby the sections may be unmated.

The overcenter spring action together with a set of high pitch threads which are rotated with the breech lock are effective to insure the electrical contacts being either fully mated or fully separated whereby the connector is either fully operative or totally inoperative.

DRAWINGS

Figure 1:
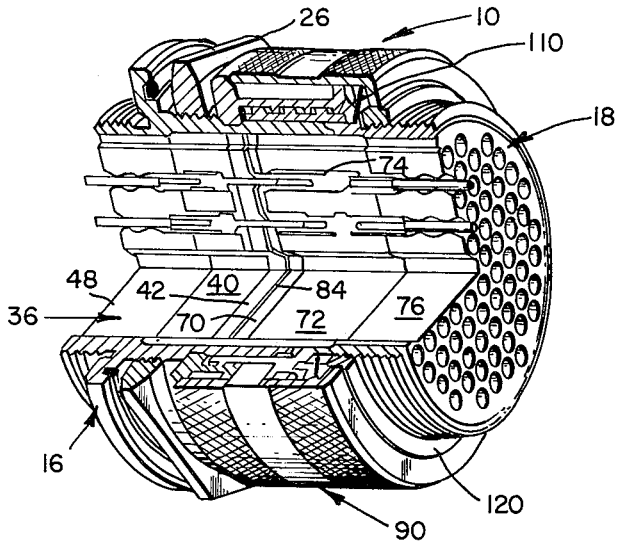
FIG. 1 is a break away perspective view of an electrical connector embodying one form of the present invention, the plug and receptacle sections of the connector being shown in a fully mated condition.

FIGS. 4A to 4D are a series of fragmentary cross-sectional views (on a somewhat enlarged scale) of the connector illustrating the movement of the various parts of the connector as the plug section is progressively mated with the receptacle section; and FIGS. 5A to 5D are a series of cross-sectional views (similar to and on the same scale as FIGS. 4A to 4D) illustrating the movement of the various parts of the connector as the plug section is progressively unmated from the receptacle section.

DESCRIPTION

The present invention is particularly adapted to be embodied in an electrical connector 10 for interconnecting the various individual wires or conductors in a first cable 12 with the corresponding wires or conductors in a second cable 14. The connector 10 includes two separate parts which may be readily mated or unmated. The first part is referred to herein as the receptacle section 16 whereas the second part is referred to as the plug section 18.

The receptacle section 16 includes a shell or receptacle insert housing 20. The exact shape, size, configuration, etc., of the housing 20 is dependent upon the intended use for the connector. The present receptacle section 16 is intended to be permanently mounted in a fixed position on a bulkhead 22. Accordingly, a mounting flange 24 is provided on the housing 20 so as to engage the backside of the bulkhead 22. Fastening means such as a mounting nut 26 is threaded onto the housing 20 so as to compress the bulkhead 22 against an O-ring seal and the mounting flange 24.

Although the housing 20 may be made of any desired material, it is preferably electrically conductive and fabricated from a light-weight metal such as aluminum. The insert housing 20 is an essentially cylindrical, hollow member. When the section 16 is secured in position on the bulkhead 22 the front or barrel 27 of the insert housing 20 extends outwardly from the bulkhead 22.

A passage 28 extends axially through the housing 20 from one end to the other. Although, this passage 28 is substantially cylindrical, in the present embodiment it is subdivided into two separate segments 30 and 32. The two segments 30 and 32 are separated from each other by an inclined annular shoulder 34.

An insulating structure 36 is disposed in the passage 28 for retaining all of the electrical contacts in position. A large number of small openings extend axially through the insulating structure or the separate electrical contacts. The electrical wires in the cable 12 extend into the rear of the passages and are connected to the individual electrical contacts 38.

The insulating structure 36 may be a single member. However, in the present instance it is formed from two separate inserts 40 and 42 which are bonded together. This allows a contact retainer 44 in each passage to be trapped between the two inserts 40 and 42 when they are bonded together. As a result when the contact is pushed into the passage it will be trapped and retained in positon in the passage. Although the contacts 38 may be of any variety, in this embodiment the contacts 38 in the receptacle section 16 are of the so-called pin variety. These contacts 38 include long slender pins 46 adapted to mate with complementary socket contacts in the plug section. In order to prevent dirt, dust, moisture, etc., entering into the connector 10 it is desirable to provide some form of protection such as a seal. This is particularly true with regarding to the rear of the receptacle section 16 where the cable 12 and the individual wires enter the insert 40. In this embodiment this is accomplished by means of a seal 48 which fits into the passage 28 and engages the rear of the insert 42. The seal 48 is normally a resilient material such as a silicone rubber, etc.

A large number of small openings extend through the seal 48. These are in alignment with the openings in the inserts 40 whereby the individual conductors or wires from the cable 12 pass through the seal 48 to the contacts 38. This seal 48 is effective to prevent dirt, dust, moisture, etc., from entering into the interior of the connector 10.

A backing or pressure plate 50 may be provided on the rear of the seal 48. A plurality of small openings through the center portion of the plate 50 allows the individual conductors from the cable 12 to pass therethrough.

Since the seal 48 is made of a noncompressible material such as a silicone rubber, if the pressure plate 50 is forced axially against the seal 48 the material in the seal 48 will tend to flow radially in all directions. As a consequence, it will be forced into intimate contact with the passage, the conductors, etc. This in turn insures an intimate, high pressure contact against all of the surfaces whereby a high degree of sealing is insured.

In this type of connector 10 some form of highly effective, electrical grounding or shielding is customarily employed to prevent electromagnetic interference, etc. The cables 12 and 14 normally include electrically conductive outer jackets which act as the shielding for the cable. In order to preserve this shielding, the jackets on the cables 12 and 14 should all be electrically tied together by means of the connector 10.

In order to accomplish this, an electrically conductive back shell 52 is electrically connected to the jacket or shielding on the cable 12. In addition a radial flange on the back shell 52 seats on the flange for the pressure plate 50. When the nut 54 is tightened, the two flanges are compressed against the end of the housing 20 whereby they are all firmly clamped in position. This arrangement is effective to produce a low resistance electrical path between shielding on the cable 12, the back shell 52, the housing 20 and the pressure plate 50.

Figure 2:
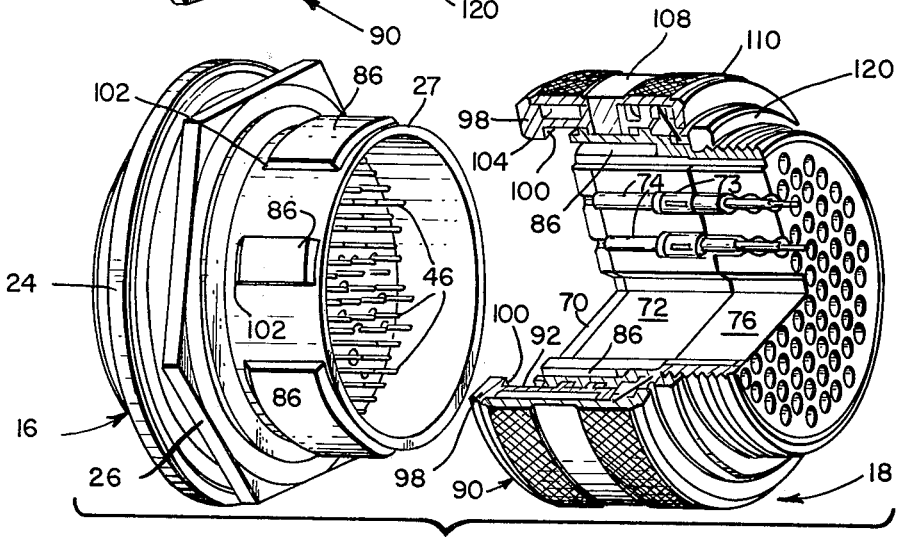
FIG. 2 is a perspective view of the connector of FIG. 1 with the plug and receptacle sections being shown in the unmated condition (the plug section being partially broken away to show the internal structure thereof)

As indicated above when the receptacle section 16 is secured to the bulkhead 22 the barrel 27 of the housing 20 projects from the bulkhead 22 at substantially right angles thereto. As may be best seen in FIG. 2 the barrel 27 has a generally cylindrical exterior whereby the plug section 18 may fit over the barrel 27 when the two sections 16 and 18 are mated.

The plug section 18 includes an inner shell or insert housing 55. The housing 55 is a generally cylindrical member having a passage 56 extending axially therethrough. Although the passage 56 may be of a uniform diameter in this embodiment it is subdivided into at least three separate segments 58, 60 and 62. The front or forward segment 58 is an enlarged part and has a diameter adapted to snugly fit over the exterior of the barrel 27.

The second or middle segment 60 of the passage 56 is separated from the first part by a forwardly facing radial shoulder 64. The inside diameter of the middle segment 60 is substantially the same as the diameter of the end segment 32 of the passage 28 in the receptacle section 16. The rear segment 62 of the passage 56 has a somewhat reduced diameter and is separate from the middle segment 62 by an annular shoulder 66 similar to the shoulder 34.

An insulating structure 68 is provided in the passage 56. The insulating structure 68 which may be generally similar to the first insulating structure 36 and includes a front insert 70 and a rear insert 72. Individual electrical contacts 74 are mounted in the individual passages extending axially through the inserts 70 and 72 and are retained in position by the contact retainer 73.

Although these contacts 74 may be of any desired variety, they preferably mate with the contacts 38 in the receptacle section 16. In the present instance since each of the contacts 38 in the receptacle section 16 include a long slender pin 46, each of these contacts 74 is in the form of a hollow socket.

Each socket has an opening therein which is aligned with an opening on the front face of the insert 70. When the receptacle section 16 and the plug section 18 are fully mated, the pins 46 project from the face of the insert 42 and pass through the openings into the sockets. This is of course effective to maintain an electrically conductive path between the respective contacts 38 and 74.

The individual wire or conductors in the second cable 14 extend through the openings in the rear insert 72 and are connected to the contacts 74. It can thus be seen that by joining the two sections 16 and 18 all of the individual wires in each of the cables 12 and 14 are electrically interconnected with the respective individual wires in the other cable.

The rear of the plug section 18 also includes a resilient seal 76. This seal 76 may be similar to the seal 48 in the receptacle section 16 and compressed by a pressure plate 78 similar to the first pressure plate.

A nut 80 is threaded onto the exterior of the insert housing 55. When this nut 80 is tightened it is effective to force the backshell 82 and pressure plate 78 against the seal 76.

In addition to the two seals 48 and 76, it is also very desirable to provide some form of interface sealing between the mating faces on the two front inserts 42 and 70. In the present instance this interface seal 84 is in the form of a thin wafer of an elastomeric material such as silicone rubber, etc. The wafer or seal 84 includes a large number of small openings which allow the pins 46 to extend therethrough. It has been found desirable for the pins 46 to be a snug fit in these openings whereby the wafer or seal 84 will normally remain on the face of the plug section 18.

When the two sections 16 and 18 are fully mated, the thin interface seal 84 is compressed between the faces of the two inserts 42 and 70. As a result the elastomeric material in the seal 84 tends to flow into and against all of the surfaces and thereby provides a complete and effective sealing action. A tapered projection may be provided on the seal 84 around each pin 48. These projections extend into complementary recesses in the face of the insert. The mating and compressing together of these tapered surfaces will further enhance the interface sealing action.

It can be seen that when the plug section 18 is fully mated with the receptacle section 16 all of the wires, contacts, etc., are completely enclosed within a continuous electrically conductive path from the shielding on one cable 12 all the way to the shielding on the other cable 14. This is very effective to insure a very high degree of shielding against any stray electromagnetic energy which may be incident upon the connector 10.

However, it has been found that under some extreme circumstances a certain amount of difficulty may arise. This is particularly true when energy circulating in the shielding is of an extremely high frequency. To avoid this difficulty an annular ring 86 of a highly conductive metal may be provided between the abutting ends of the two housings 20 and 55. This ring 86 which has a U-shaped cross section is resilient whereby it can be very easily compressed between the two housings 20 and 55 as they approach each other. This ring 86 provides a low impedance coupling between the housings at even very high frequencies.

As indicated above, when the receptacle section 16 and the plug section 18 are mated, the enlarged segment 58 of the passage 56 in the plug insert housing 55 fits snugly over the exterior of the barrel 27 on the receptacle insert housing 20. Preferably these are "polarized" whereby they can only mate in one unique angular orientation. In the present instance, this is accomplished by providing a plurality of projections or keys 86 on the exterior of the barrel 27 (see FIG. 2).

In addition, a plurality of cutouts or key-ways 88 are provided on the inside surface of the enlarged segment 58 of passage 56. When the two insert housings 20 and 55 are brought together the projecting keys 86 on the barrel 27 fit into the recessed key-ways 88 in the passage 56. Since these are asymmetrically distributed and vary in width they can only mate in only one unique angular position. This insures a proper continuity between the various contacts.

Suitable means are provided for securing the plug section 18 on the receptacle section 16 after they ahve been properly mated. Although any suitable fastening means may be employed, in this embodiment a so-called breech lock 90 is provided. The breech lock 90 includes a retainer sleeve 92 rotatably disposed upon the exterior of the insert housing 55 and a flange 98 on the end of the sleeve 92. This flange 98 forms a shoulder 100 which is effective to fit behind the shoulder 102 formed by the keys 86.

The interior of the retainer sleeve 92 and the exterior of the housing 55 include sets of matching screw threads 94 and 96. In the present instance there are two sets of threads, i.e., they are actually double threads. The threads 94 and 96 preferably have square cross sections with the spaces between the threads 94 and 96 being considerably wider than the threads 94 and 96. This provides a clearance spaces 98 and 100 whereby the retainer sleeve 92 can move axially along the insert housing 55.

In addition the two sets of threads 94 and 96 preferably have a very high pitch. As a result a small amount of rotation will cause a large amount of axial movement. More particular, when the retainer sleeve 92 is rotated by about one-fourth to one-third of a revolution (i.e., the amount required to operate the breech lock 90) the insert housing 55 will move axially through the retainer sleeve 92 from a fully retracted position to a fully extended position.

The flange 98 on the outer end of the retainer sleeve 92 is disposed beyond the end of the housing 55. The inside surface 104 of the flange 98 forms an opening having an inside diameter just in excess of the outside diameter of the barrel 27. This is effective to allow the barrel 27 to pass therethrough the opening and into the passage 56 provided the keys and key-ways are accurately aligned.

A plurality of key-ways 106 are cut into the surface 104 of the flange 98 so as to correspond to the key-ways 88 cut into the surface of the passage 56. When the breech lock 90 is open or unlocked the key ways 106 in the flange 98 are aligned and register with the key-ways 88 in the passage 56 and the keys 86 projecting from the barrel 27. However, when the breech lock 90 is in the closed or locked position the foregoing alignment or registration is eliminated.

When the plug section 18 is fitted over the barrel 27 of the receptacle housing 20 and moved axially toward the bulkhead 22, the keys 86 on the barrel 27 will pass through the key-ways 88 and 106 in the flange 98 and the sleeve 92. Eventually the flange 98 on the end of the sleeve 92 will approach or nearly reach the mounting nut 26 (at this point the two sections 16 and 18 are semi-mated). The operator next actuates the breech lock by rotating the retainer sleeve 92 (i.e., rotating the coupling nut 108 on the outside of the sleeve 92). This will move the flange 98 behind the shoulder 102 formed by keys 86. This normally requires a small fraction of a turn, for example, approximately one-fourth to one-third of a rotation.

When coupling nut 108 and retainer sleeve 92 are rotated into the lock position shoulders 100 on the flange 98 move behind and engage the shoulders 102 on the back-sides of the keys 86. This is effective to lock the two sections 16 and 18 firmly together. The flange 98 and the shoulders 102 on the keys 86 are all positioned in a common radial plane. Accordingly, when these shoulders 100 and 102 mate, there is no threaded or screw action. Therefore moving the projecting portions of the flange 98 behind the keys 86 does not produce an axial force or movement. In other words, instead of screwing the two sections 16 and 18 together the breech lock 90 merely locks them together. Conversely, to release or unmate the two sections 16 and 18 the coupling nut 108 is merely rotated in the opposite direction until the shoulder 100 is no longer behind the shoulder 102 formed by the keys 86.

Although the keys 86 and the key-ways 88 are asymmetrically arranged around the two sections 16 and 18 they do extend circumferentially around a substantial portion of the respective sections (i.e., subtend substantial arcs). Since the mating surfaces do cover an extended length, even if they have a relatively small height a relatively large area of contact is provided for the mating surfaces in the breech lock. This insures the forces being spread out over a correspondingly large area whereby the stress between the mating surfaces is maintained relatively low. This in turn insures a lock which is easy to work manually and which does not wear, etc.

The breech lock 90 provides a very simple, fast-mating action and is effective to keep the two sections 16 and 18 securely mated during all operating conditions. However, it has been found desirable to provide additional means for insuring that all of the individual electrical contacts 38 and 74 are moved into and out of electrical contact without damage or mismatching and are maintained in proper electrical engagement at all times.

In order to accomplish this, the insert housing 55 is made axially moveable within the plug section 18. More particularly the housing 55 is moveable between a fully retracted position (i.e., the unmated condition) and an extended position (i.e., the mated condition). The axial movement of the insert housing 55 is in part controlled by the threads 94 on the outside of the insert housing 55 mating with the threads 96 on the inside of the retainer sleeve and in part by a spring.

When the coupling nut 108 is turned to actuate the breech lock 90, the retainer sleeve 92 is rotated about the insert housing 55. It should be observed that the keys 86 riding in the key-ways 88 will prevent the housing 55 rotating with the retainer sleeve 92 and coupling nut 108. As a consequence, as soon as the surfaces of shoulders 100 on the flange 98 move behind the shoulder 102 on the keys 86 rotation of the sleeve 92 will cause the threads 94 and 96 to move the housing 55 axially toward the extended position. Rotation in the opposite direction will of course cause the housing 55 to move toward the retracted position.

As previously indicated the threads 94 and 96 preferably have a very high pitch; i.e., the amount of axial movement is very large for a small amount of angular rotation. By way of example, the pitch of the threads 94 and 96 is large enough to move the insert housing 55 between its fully retracted position and its fully extended position when the retaining sleeve 92 and coupling nut 108 are rotated through a small fraction of a turn such as one-fourth to one-third of a revolution. Normally this is about the same as the amount of rotation required to fully operate the breech lock 90.

A spring 110 or similar device is employed for biasing the moving parts of the connector 10 into the desired positions. The biasing action is preferably of an over-center variety which is effective to produce a snap or toggle action. More particulary, this action tends to force the parts in either one direction or the other direction. Moreover, the reversal of the direction is substantially instantaneous whereby a snap action is created.

It has been found that a Belleville washer or spring 110 is particularly well suited for this purpose. Such a spring 110 is essentially a conical washer having an outer rim 112 and an inner edge 114. The characteristics of such a spring 110 when it is essentially unconfined are illustrated by the dashed line 116 in FIG. 3. The horizontal scale or abscissa represents the displacement of the inner edge of the spring. The vertical scale or ordinate represents the force created by the inner edge 114 as a result of the spring action.

When the spring 110 is in one extreme position, for example at point 117 (FIG. 3) the inner edge 114 is at one extreme deflection and there is no force exerted by it. As the inner edge 114 is moved toward the right the force builds up to a maximum. As the movement progresses beyond this maximum point the amount of force decreases.

At the point 118 the outer rim 112 and the inner edge 114 are all in the same plane. In other words the spring 110 is perfectly flat. At this point the inner edge 114 exerts no force in either direction. However, as the movement continues the inner edge 114 travels through this point and the direction of the force reverses.

Figure 3:
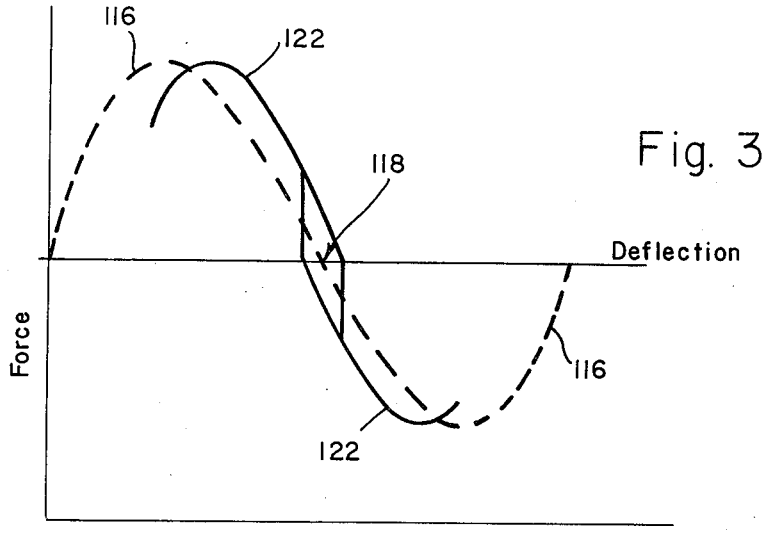
FIG. 3 is a graph of certain operating characteristics of the connector.

After the inner edge 114 has moved past the center position the force reverses its direction (i.e., it becomes negative as seen in FIG. 3). As the deflection increases the force builds up to a maximum negative level and then returns to zero when the inner edge 114 reaches the other extreme position 119.

The foregoing description of the spring 110 and the curve 116 are those of a normal Belleville Washer. However, when the spring 110 is embodied in the connector its action is preferably modified to correspond to curve 112. The outer rim 112 of the spring 110 is trapped or compressed between the end of the retainer sleeve 92 and the end of the coupling nut 108. As a consequence the outer rim 112 of the spring 110 moves axially with the coupling nut 108. The inner edge 114 of the spring 110 is trapped between a shoulder on the insert housing 55 and a nut 120 which is threaded onto the exterior of the housing 55.

It will thus be seen that the inner edge 114 of the spring 110 tends to bias the insert housing 55 axially through the retainer sleeve 92. Although this biasing action may correspond to the curve 116, as indicated above it is preferably modified to produce a biasing action illustrated by the solid lines 122 in FIG. 3.

The inner edge 114 and the outer rim 112 may be firmly coupled to their respective parts whereby there is no slack or play between the spring and the parts. In this event the spring 110 will bias the connector essentially the same as curve 116. However, in the present instance there is a small amount of "play" or lost motion between the inner edge 114 and/or the outer rim 112 of the spring 110. (It should also be noted a certain amount of lost motion is present between the mating threads 94 and 96). This lost motion in the mounting of the spring 110 results in a spring action similar to that shown by curve 122. This curve illustrates the addition of a certain amount of hysteresis. This greatly enhances the snap action or toggle effect. This can be readily heard and felt when the connector is mated or unmated to indicate the mating or unmating action has been accomplished.

When the connector is unmated the condition of the spring corresponds to point 121. When the two sections are joined and the breech lock 90 is rotated the spring 110 is deflected to the right as seen in FIG. 3. As this motion progresses the force increases to the maximum level and then decreases to zero at point 125 when the spring is flat. The slightest additional movement will cause the inner edge 114 to move over center.

Since there is a certain amount of lost motion in the mounting of the spring, the spring will abruptly move over-center and twist slightly within its mounting. As a consequence, instead of a gradual reverse in the direction of the force according to curve 116, the force very abruptly reverses and instantly jumps to a substantial negative amount. When the force reverses its direction in this manner, it now biases the parts firmly together. Once the spring 110 snaps over-center it is necessary for the deflection to move a significant distance back (i.e., retreat from point 125 to point 127) before the spring 110 can again go over-center. This is effective to eliminate the possibility of an ambiguous or unstable condition existing. Continued rotation in the mating direction will move the spring on over to the terminal or fully mated point 123.

During unmating the spring 110 moves in the reverse direction from point 123 to point 121 with the same action but in the opposite direction. There is of course a reversal in the hysteresis action.

Figure 4:
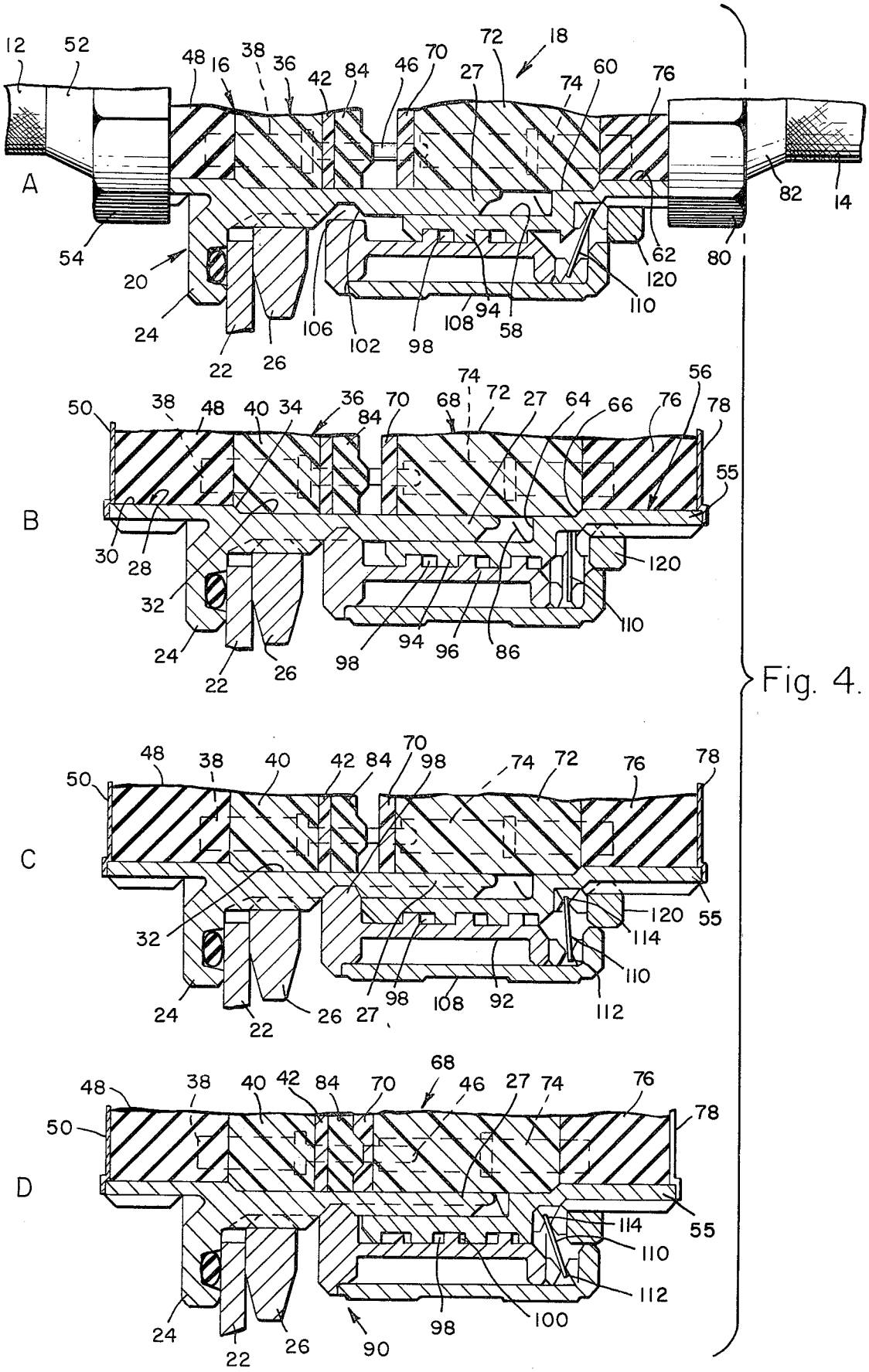

Assume the two sections 16 and 18 of the connector 10 are separated and it is desired to mate them. In this event the plug section 18 is first brought up to the receptacle section 16 and partially mated essentially as seen in FIG. 4A. The interior surface formed by the large segment 58 of the passage 56 slides axially along the exterior of the barrel 27 and the ends of the pin contacts 38 just extend into the insulating structure 68. Normally there will be no electrical contact. The co-action of the keys 86 and keyways 88 prevents relative rotation, ensures proper angular orientation and axial alignment of the complementary parts.

At this point the breech lock 90 is not set and the two sections 16 and 18 can still be readily pulled apart. However, the shoulder 100 on the inside of the flange 98 is disposed axially beyond the shoulder 102 formed by the keys 86.

Next the coupling nut 108 is rotated in the mate direction. During this rotation the structure of the connector 10 will first pass through the configuration shown in FIG. 4B. The first event which occurs is the movement of the shoulder 100 on the flange 98 behind the keys 86. As soon as the flange 98 is behind the keys 86 the two sections 16 and 18 are locked together and cannot be separated. It should be noted that the mating surfaces 100 and 102 in the breech lock 90 are all in a common transverse plane. As a consequence, there is no threading action when they engage that would tend to force the two sections 16 and 18 to move axially. However, as soon as the rotation of the coupling nut 108 commences the front side of the threads 96 on the retainer sleeve 92 ride along the backside of the threads 94 on the retainer sleeve 92. This threading or screw action causes axial movement of the insert housing 55 through the sleeve 92. This causes the various parts of the plug section 18 to advance toward their corresponding counterparts in the receptacle section 16.

For example, the insulating structure 68 will advance toward the interface seal 84 whereby the pins 46 will extend into the socket contacts 74. At the same time the inside edge 114 of the spring 110 will move axially with housing 55. Since the outer rim 112 is clamped between the end of the retainer sleeve 92 and the end of the coupling nut 108, the spring 110 is progressively distorted until it reaches the centered position as seen in FIG. 2B.

It should be noted that up to this point the front side of the threads 96 are riding along the backside of the threads 94. The axial force of the spring 110 retains these two surfaces in sliding contact whereby all of the lost motion or clearance space is behind the thread 96 and in front of the thread 94. Accordingly, the angular rotation of the coupling nut 108 directly and positively controls the axial position of the insert housing 55. Also up to this point the axial force of the spring tends to bias the insulating structure 68, contacts 74, etc., away from the receptacle section 16.

At this point the slightest amount of additional turning of the coupling nut 108 causes the spring to move over-center. When this occurs the inner edge 114 of the spring 110 instantly snaps over-center and into the position seen in FIG. 4C. Because of the lost motion at rim 112 and/or edge 114 the spring 110 snaps over-center and inner edge 114 very substantially exerts a force tending to drive the moving parts of the plug section axially toward the receptacle section. At this point on the threads 94 and 96 are separated. Because of this lost motion the angular position of the coupling nut 108 does not directly control the axial positions of the movable parts in the plug section, instead they are controlled by the spring.

There is a considerable amount of lost motion or spacing 98 and 100 between the mating threads 94 and 96. This lost motion exceeds the amount of travel of the inner edge 114 of the spring, i.e., the distance the edge 114 travels when it moves from point 125 to point 123. When the spring 110 snaps over-center, the axial force imposed by the inner edge 114 reverses direction because of the hysteresis in curve 122 becomes substantial. Therefore, it tends to dirve all of the moving parts toward a fully mated condition as shown in FIG. 4D.

In this condition the face of the insulating structure 68 engages interface seal 84 and the pins 46 extend into the socket contact 14. The amount of travel required to perfect the mating is less than the amount of play or lost motion between the sets of threads 94 and 96. Accordingly, there will be a space 98 and 100 between the respective threads 94 and 96.

Because of this play or lost motion in the mating action between the threads 94 and 96, the spring 110 is free to bias the interior parts of the connector 10 together. This imposes a compressive load on the interface seal 84 and all of the other parts which are trapped between the two shoulders 34 and 66. The axial, compression force produced by the spring is adequate to maintain a suitable compressive load on this structure and in particular on the interface seal.

It can be appreciated that irrespective of the normal variations in the dimension of parts of the connector and/or the interface seal shrinking, taking a permanent set, etc., the spring will always continue to exert a substantially constant axial force on all of the parts. Accordingly, an optimum mating action is created and maintained at all times.

Figure 5:
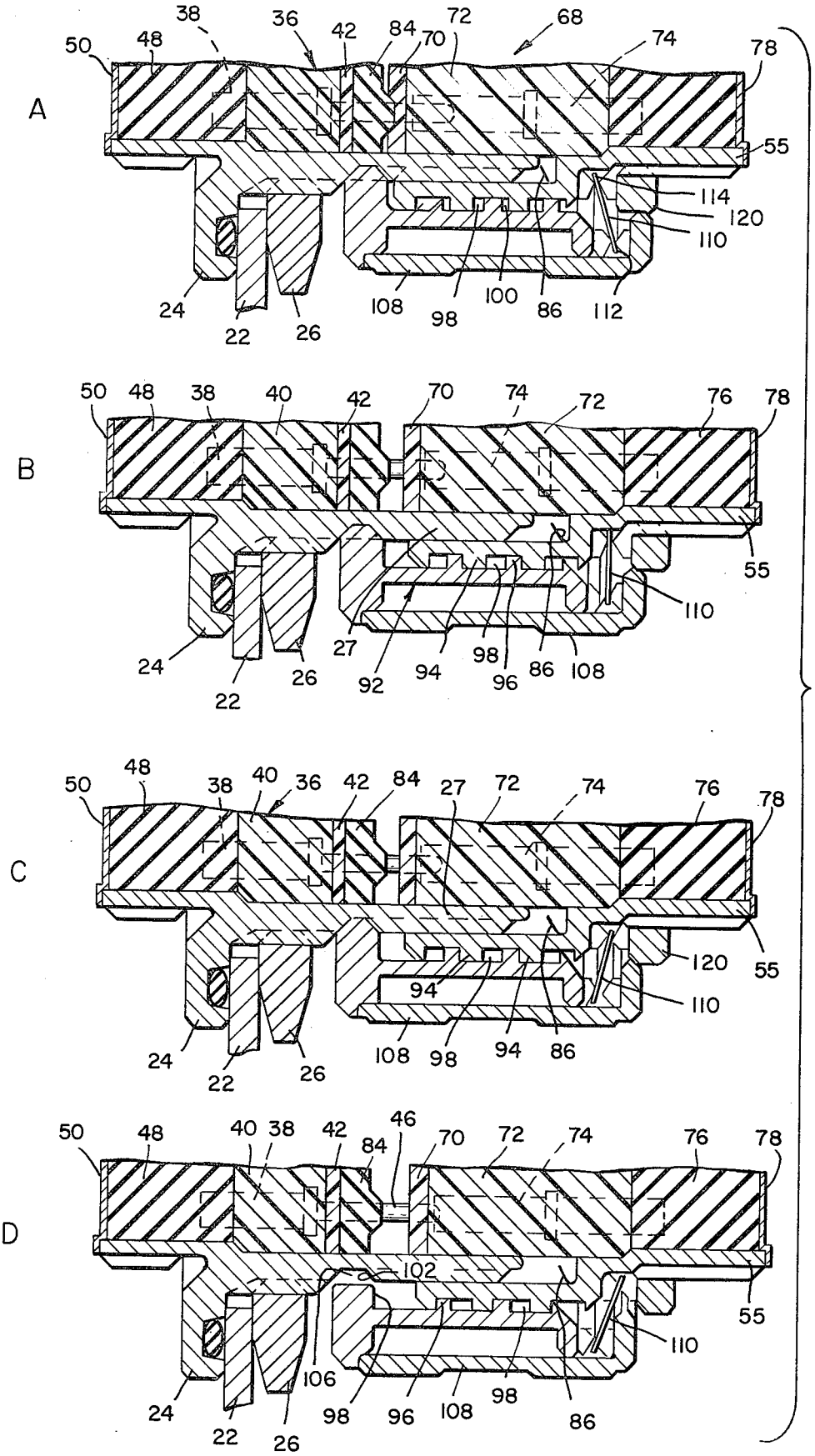

Assume the two sections 16 and 18 are fully mated as seen in FIG. 5A and it is desired to separate them. When the two sections are fully mated substantially as shown in FIGS. 4D and 5A they are locked together by the breech lock 90 and the spring retains the various parts such as the interface seal 84 properly compressed and mated.

To separate the two sections 16 and 18 from each other, the breech lock 90 is rotated in the unmated direction. When this rotation occurs, the threads 96 will move axially whereby the backside thereof comes into engagement with the front side of the threads 94. When this occurs the clearance space 100 disappears.

During this initial phase of the rotation the spring 110 is being distorted whereby the rotation of the coupling nut 108 is accidentially rotated (for example by acceleration or vibratory force, etc.) the spring 110 opposes the forces and tends to return the coupling nut 108 to its original position. Also even though there may be a substantial amount of rotation of the coupling nut 108 because of the lost motion in the threads 94 and 96, etc., the spring 110 is effective to still maintain the contacts, interface seal, etc., all fully compressed and mated.

Further rotation of the coupling nut 108 will move the inner part of the spring toward the balanced position shown in FIG. 5B. At this point the screw action produced by thread 94 working against thread 96 has moved the insulating structure 68 and separated the interface seal 84 and the contacts 46 and 74.

The slightest additional rotation of the coupling nut 108 will cause the spring to snap over-center and into the position shown in FIG. 5C. At this instance the spring reverses the direction of the axial force and tends to now drive the moving parts in the opposite direction whereby they are fully separated and there is little or no axial force on the connector 10 and in particular on the mating surfaces of the breech lock 90.

The further and final rotation of the coupling nut 108 will fully open the breech lock 90 and move the shoulder 100 from the backside sides of the keys 86. Accordingly, at this point the plug section 18 may be freely pulled axially and become completely separated from the receptacle section 16.

I claim:

1. The combination of a plug section, a receptacle section effective to mate with said plug section, means for releasably securing said plug and receptacle sections together, a movable portion on one of said sections, said portion being movable relative to said section between a fully mated position and a fully unmated position, complementary threads on at least one of said sections for moving said sections between the fully mated position and the fully unmated portion, said threads having a predetermined amount of clearance therebetween whereby said sections may move axially relative to each other by said amount, said clearance being so large that the threads do not engage when said portion is in the fully mated position and said spring is free to resiliently bias the portion into the fully mated position, and a spring effective to coact with said sections and create an axial force tending to maintain said portion biased into the fully mated position.

2. The combination of claim 1 wherein the complementary threads include first and second sets of threads that mate with each other, said first and second sets of theads being disposed on the same section.

3. The combination of a plug section, a receptacle section effective to mate with said plug section, means for releasably securing said plug section and receptacle section together, a movable portion on one of said sections, said portion being movable between a fully mated position and a fully unmated position, complementary threads on at least one of said sections for moving said portion between said fully mated position and a fully unmated position, said threads having a predetermined amount of clearance space therebetween whereby said portion may move axially relative to said sections by said amount, a bistable spring effective to coact with said sections and create an axial force on said portion, said spring when in one stable condition being effective to bias said threads one way and when in the other stable condition being effective to bias said threads in the opposite direction, and said clearance space being so large that when said portion is in the fully mated position, said threads do not engage each other and said bistable spring is free to resiliently bias said portion into its fully mated position.

4. The combination of claim 3 wherein the complementary threads include first and second sets of threads that mate with each other, said first and second sets of threads being disposed on the same section, and said means for releasably securing said sections together is operatively interconnected with said spring by said threads whereby said means is effective to move said spring between its two stable positions.

5. The combination of claim 3 wherein said bistable spring is a Belleville washer.

6. The combination of claim 3 wherein said means for releasably securing said sections together includes a breech lock movable between a lock position wherein said sections are secured together and an unlock position wherein said sections are released, and said breech lock being effective to move said spring from one stable condition to the other stable condition when said lock moves from one of said positions to the other position.

7. The combination of a plug section, a receptacle section, said sections being effective to mate with each other, a movable portion on one of said sections, said portion being movable between a mated position and an unmated position, retainer means for securing said sections together, complementary threads on at least one of said sections effective to mesh with each other and being interconnected with the movable portion for moving said portion, said threads having a predetermined amount of clearance therebetween whereby one of said threads may move axially relative to the other by said amount, and said portion is free to "float" by said amount, and a bistable spring effective to coact with said retainer means, said spring being effective in one stable condition to create an axial force tending to move said threads axially relative to each other in one direction and effective in the other stable condition to create an axial force tending to move said threads axially relative to each other in the opposite direction.

8. The combination of claim 7 wherein the complementary threads include first and second sets of threads that mate with each other, said first and second sets of threads being disposed on the same section.

9. The combination of claim 7 wherein said bistable spring is a Belleville washer.

10. The combination of claim 7 wherein said bistable spring is a Belleville washer, and said retainer includes a breech lock.

11. The combination of a first section, a first set of electrical contacts in said first section, a second section effective to mate with said first section, a second set of electrical contacts in said second section, said second set of electrical contacts being movable within said second section between an extended position wherein the electrical contacts in said first set mate with the electrical contacts in said second set when said sections are mated and a retracted position wherein said contacts are separated, a bistable spring effective to move over-center between either a first position or a second position, said spring when in the first position being effective to bias said second set of contacts into said extended position wherein said sets of contacts are mated, said spring when in said second position being effective to bias said sets of contacts into said retracted position wherein said sets of contacts are separated, and a lock for releasably securing said sections together, said lock being effective to move said spring into either the first position or the second position.

12. The combination of a receptacle section, a first set of electrical contacts in said receptacle section, a plug section effective to mate with said first section, a member movably disposed in said plug section, said member being movable between an extended position and a retracted position, a second set of electrical contacts disposed upon said member and movable therewith, said second set of electrical contacts being adapted to mate with the first set when said member is in said extended position and adapted to separate when said member is in the retracted position, a Belleville washer effective to move overcenter between either a first position or a second position, said washer when in the first position being effective to bias said member toward said extended position wherein said sets of contacts are mated, said washer when in said second position being effective to bias said member toward said retracted position wherein said sets of contacts are separated, a breech lock movable between a first position for securing said receptacle and plug sections together and a second position for releasing said sections, a retainer sleeve in said breech lock, and complementary threads on said retainer sleeve and said member, said threads having a predetermined amount of clearance therein, whereby said member may move relative to said retainer by said amount, said threads being effective when said breech lock is in said first position to move said member into said extended position and said washer into said first position, said threads being effective when said breech lock is in said second position to move said member into said retracted position and said washer into said second position.

13. The combination of a plug section, a receptacle section effective to mate with said plug section, retainer means on one of said sections, said retainer means being movable between a first position for securing said sections together and a second position for releasing said sections whereby they may be separated from each other, a first set of electrical contacts on one of said sections, a second set of electrical contacts on the other of said sections for mating with the first set of electrical contacts, one of said sets of contacts being movable between a retracted or unmated position and an extended or mated position, lost motion means interconnecting the movable set of contacts with said retainer means, said lost motion means being effective to move said set of contacts between said mated position and said unmated position as said retainer means moves between said first and second positions, said lost motion means having a predetermined amount of lost motion whereby said last set may move by said amount, and a bistable spring effective to bias the movable set of contacts toward the mated position or the unmated position when retainer means moves between said first and second positions.

14. The combination of a plug section, a receptacle section effective to mate with said plug section, retainer means on one of said sections, said retainer means being movable between a first position for securing said sections together and a second position for releasing said sections whereby they may be separated from each other, a first set of electrical contacts on one of said sections, a second set of electrical contacts on the other of said sections for mating with the first set of electrical contacts, one of said sets of contacts being movable between a retracted or unmated position and an extended or mated position, lost motion means interconnecting the movable set of contacts with said retainer means, said lost motion means being effective to move said set of contacts between said mated position and said unmated position as said retainer means moves between said first and second positions, said lost motion means having a predetermined amount of lost motion whereby said last set may move by said amount, said retainer means includes a breech lock, said lost motion means includes sets of mating threads, a Belleville washer interconnected with the movable set of contacts and said lost motion means so as to act as a bistable spring having a first stable position and a second stable position, said spring when in one position being effective to bias the set of contacts in one direction and when in the other position being effective to bias the set of contacts in the other direction, and said threads being effective to move said spring between said positions.

15. The combination of a plug section, a first set of electrical contacts on said plug section, a receptacle section effective to mate with said plug section, a second set of electrical contacts on said receptacle section for mating with the first set of electrical contacts, retainer means movable between first and second positions for securing said sections together and for releasing said sections whereby they may be separated from each other, one of said sets of contacts being movable between a retracted or unmated position and an extended or mated position, thread means interconnecting said movable set of contacts with said retainer means, said thread means including a first set of spiral threads and a second set of spiral threads, the threads in one set mating with the space between the threads in the other set whereby rotation thereof is effective to move said set of contacts between said mated position and said unmated position as said retainer means moves between said first and second positions, spring means effective to bias the movable set of contacts into the extended or mated position, and the space between the threads in each set being considerably wider than the teeth in the other set so that said thread means have a predetermined amount of lost motion therein which is equal to the difference between the width of the thread and the width of the space and is effective to allow the movable set of contacts to be free to travel a distance corresponding to said amount of lost motion, said amount of lost motion being large enough to allow said spring means to maintain the spring in the extended position without either thread engaging the other.

16. The combination of a plug section, a receptacle section, said sections being effective to mate with each other, securing means movable between a lock position for securing said sections together, and an unlocked position for releasing said sections for separation from each other, complementary electrical contacts on said sections effective to electrically mate with each other, the contacts in one section being movable a predetermined distance, and toggle means having a first stable condition and a second stable condition, means interconnecting the toggle means with the electrical contact, said toggle means being effective when moved into one stable condition to create a force tending to move said contacts said distance relative to each other in one direction whereby they are separated, said toggle means being effective when moved into the other stable condition to create a force tending to move said contacts said distance relative to each other in the opposite direction whereby they are mated.

17. The combination of a plug section, a receptacle section, said sections being effective to mate with each other, securing means movable between a lock position for securing said sections together, and an unlocked position for releasing said sections for separation from each other, complementary electrical contacts on said sections effective to electrically mate with each other, the contacts in one section being movable a predetermined distance, toggle means having a first stable condition and a second stable condition, means interconnecting the toggle means with the electrical contact, said toggle means being effective when moved into one stable condition to create a force tending to move said contacts said distance relative to each other in one direction whereby they are separated, said toggle means being effective when moved into the other stable condition to create a force tending to move said contacts said distance relative to each other in the opposite direction whereby they are mated, and means interconnecting said securing means with said toggle means, said securing means being effective to move said toggle means from one stable condition to the other stable condition when said securing means moves from one of said positions to the other position.

18. The combination of a plug section, a receptacle section, said sections being effective to mate with each other, securing means movable between a lock position for securing said sections together, and an unlocked position for releasing said section for separation from each other, complementary electrical contacts on said sections effective to electrically mate with each other, the contacts in one section being movable a predetermined distance, toggle means having a first stable condition and a second stable condition, means interconnecting the toggle means with the electrical contact, said toggle means being effective when moved into one stable condition to create a force tending to move said contacts said distance relative to each other in one direction whereby they are separated, said toggle means being effective when moved into the other stable condition to create a force tending to move said contacts said distance relative to each other in the opposite direction whereby they are mated, and means interconnecting said securing means with said toggle means for moving said toggle means from one stable condition to the other stable condition when said securing means moves from one position to the other position, said toggle means being effective to produce an audible sound when it moves from one of said stable conditions to the other stable condition.

19. The combination of a plug section, a receptacle section, said sections being effective to mate with each other, securing means movable between a lock position for securing said sections together, and an unlocked position for releasing said sections for separation from each other, complementary electrical contacts on said sections effective to electrically mate with each other, the contacts in one section being movable a predetermined distance, toggle means having a first stable condition and a second stable condition, means interconnecting the toggle means with the electrical contact, said toggle means being effective when moved into one stable condition to create a force tending to move said contacts said distance relative to each other in one direction whereby they are separated, said toggle means being effective when moved into the other stable condition to create a force tending to move said contacts said distance relative to each other in the opposite direction whereby they are mated, and means interconnecting the securing means with said toggle means, said lost means being effective to move said toggle means from one stable condition to the other stable condition when said securing means moves from one of said positions to the other position, said toggle means being effective to create a force on said securing means that changes abruptly when said securing means moves from one of said positions to the other of said positions.

20. The combination of a plug section, a receptacle section, said sections being effective to mate with each other, securing means movable between a lock position for securing said sections together, and an unlocked position for releasing said sections for separation from each other, complementary electrical contacts on said sections effective to electrically mate with each other, the contacts in one section being movable a predetermined distance, toggle means having a first stable condition and a second stable condition, means interconnecting the toggle means with the electrical contact, said toggle means being effective when moved into one stable condition to create a force tending to move said contacts said distance relative to each other in one direction whereby they are separated, said toggle means being effective when moved into the other stable condition to create a force tending to move said contacts said distance relative to each other in the opposite direction whereby they are mated, a breech lock in said securing means movable between a lock position wherein said sections are secured together and an unlock position wherein said sections are released, and means interconnecting said breech lock with said toggle means for moving said toggle means from one stable condition to the other stable condition when said breech lock moves from one of said positions to the other position.

21. The combination of a plug section, a receptacle section, said sections being effective to mate with each other, means for securing said sections together, complementary electrical contacts on said sections effective to electrically mate with each other, the contacts in one section being movable a predetermined distance, bistable biasing means having first and second stable conditions, and means interconnecting said bistale means with said electrical contacts for moving said contacts bistable one direction relative to each other whereby said contacts are separated when said sections are separated and in the opposite direction whereby said contacts are mated when said sections are mated.

* * * * *